US006133892A

United States Patent [19]

Borgwardt

[11] Patent Number: 6,133,892

[45] Date of Patent: Oct. 17, 2000

[54] METHOD AND APPARATUS FOR PRODUCING DUAL VIEW DISPLAYS

[76] Inventor: Stephen P. Borgwardt, 4425 Somerset La., Madison, Wis. 53711

[21] Appl. No.: 09/081,346

[22] Filed: May 19, 1998

Related U.S. Application Data

[60] Provisional application No. 60/047,395, May 22, 1997.

[51] Int. Cl.[7] ..... G09G 5/00; G09F 19/14

[52] U.S. Cl. ..... 345/1; 40/453

[58] Field of Search ..... 345/1; 264/505; 40/126, 137, 160, 453, 470, 594, 605

[56] References Cited

U.S. PATENT DOCUMENTS

| | | | |
|---|---|---|---|
| 385,912 | 7/1888 | Coote | 40/453 |
| 824,860 | 7/1906 | Grove | 40/453 |
| 942,498 | 12/1909 | Heinemann | 40/453 |
| 990,490 | 4/1911 | Miller | 40/453 |
| 1,353,363 | 9/1920 | Simon | 40/453 |
| 1,678,475 | 7/1928 | Long, Jr. | 40/136 |
| 2,088,762 | 8/1937 | Rous | 40/137 |
| 2,851,804 | 9/1958 | Roach | 40/126 |
| 3,406,476 | 10/1968 | Wilcox | 40/137 |
| 4,233,767 | 11/1980 | Hryhorczuk | 40/453 |
| 4,255,380 | 3/1981 | Bjorkland | 264/505 |
| 4,422,253 | 12/1983 | Babberl | 40/453 |
| 4,937,960 | 7/1990 | Otake | 40/453 |
| 5,598,650 | 2/1997 | Brown | 40/453 |

*Primary Examiner*—Vijay Shankar
*Assistant Examiner*—Jeff Piziali
*Attorney, Agent, or Firm*—Craig A. Fieschko, Esq.; DeWitt Ross & Stevens S.C.

[57] ABSTRACT

A dual view display is described which displays two images, but wherein each image is visible to the exclusion of the other when the display is viewed from particular angles. A sheetlike picture inset bearing interleaved sections of the two images is situated between two transparent frame members having an accordion-folded or "zig-zag" configuration. The frame members are thus each formed of an array of planar sections wherein each planar section is at an angle to adjacent planar sections, and wherein every other planar section is parallel to a common view plane. When the display is viewed from a line of sight normal to one of the two viewing planes, the viewer sees only a single image, whereas image sections from both images are visible if the viewer sees the display from intermediate lines of sight. Methods are disclosed for producing picture inserts which automatically provide a properly-registered dual view display when placed between two frame members with the edges of the dual image aligned with the edges of the frame members.

16 Claims, 5 Drawing Sheets

METHOD AND APPARATUS FOR PRODUCING DUAL VIEW DISPLAYS

CROSS-REFERENCE TO RELATED APPLICATIONS

This application claims priority under 35 USC §119(e) to U.S. Provisional Patent Application 60/047,395 filed May 22, 1997 entitled ACCORDION DIMENSIONAL DISPLAY, the entirety of which is incorporated by reference herein.

FIELD OF THE INVENTION

This disclosure concerns an invention relating to methods and apparata for producing dual view displays which provide two images upon their viewing surface, but wherein each image is viewed to the exclusion of the other when the viewing surface is viewed from certain angles.

BACKGROUND OF THE INVENTION

Dual view displays have been known for many years as an eye-catching means for attracting a viewer's attention. In general, dual view displays are formed by providing a mounting surface formed by a series of rectangular planar surfaces of substantially equal size which are connected side-by-side. The planar surfaces are situated in a "zig-zag" or accordion-folded relation wherein each planar surface is situated parallel to one of two viewing planes, these two viewing planes being situated generally perpendicular to each other, and wherein each planar surface is parallel to a different viewing plane than the planar surfaces adjacent to it. A first image is then applied to the planar surfaces which are parallel to one viewing plane, and a second image is applied to the planar surfaces parallel to the other viewing plane. The images are applied as if each set of parallel planar surfaces was not interrupted by the other set, that is, where two parallel planar surfaces are separated by an intermediate (and perpendicular) planar surface, the image is neatly divided between the two parallel planar surfaces as if the intermediate planar surface was not present. As a result, if a viewer views the dual view display from a line of sight which is normal to the first viewing plane, the first image borne on the planar surfaces parallel to the first viewing plane appears as a coherent and substantially continuous image, and the second image is not visible. If a viewer instead views the dual view display from a line of sight which is normal to the second viewing plane, the second image borne on the planar surfaces parallel to the second viewing plane appears as a coherent and substantially continuous image, and the first image is not visible. If a viewer views the dual view display from intermediate lines of sight, sections of both images are visible, but they are commingled or "interleaved" and do not form a coherent image.

An example of a dual view display of this type is given in U.S. Pat. No. 4,937,960 to Otake. Otake illustrates a rotating three-sided display unit, each side of which constitutes an accordion-folded mounting surface bearing a dual view display. Because the three-sided unit is rotatable, one may turn the unit to see two adjacent sides of the display unit at once and thus view an image on each of these two sides. If the unit is instead rotated so that a single side of the display unit is oriented approximately normal to the viewer's line of sight, the viewer will see only the non-coherent image produced by the interleaved image sections borne on this side. Different embodiments of the display unit are illustrated in FIGS. 1 and 4 of Otake, wherein sectioned images (see FIG. 3) are interleaved and each image section is directly attached to the accordion-folded mounting surfaces; FIG. 5, wherein interleaved image sections are joined as shown in FIGS. 6, 11, and 12, accordion-folded, and then directly attached to the accordion-folded mounting surfaces; and FIG. 9, wherein an accordion-folded transparent cover is provided spaced from a planar backing wall so that the aforementioned attached image sections of FIGS. 6, 11, and 12 may be accordion-folded and fit between the cover and backing wall. FIGS. 10 and 13 also illustrate single-sided display units wherein the accordion-folded attached image sections of FIGS. 6, 11, and 12 may be fit and wherein no accordion-folded mounting surface is provided, but wherein flanges nevertheless hold the attached image sections in an accordion-folded shape. The Otake embodiments which illustrate direct fixation of image sections to an accordion-folded mounting surface have the advantage that they will always firmly maintain the image sections at the desired viewing angle, but they have the disadvantage that they do not allow removal and replacement of the image sections. In contrast, the embodiments of FIGS. 9, 10, and 13 allow removal and replacement of image sections, but the lack of support of the image sections (i.e., the lack of any means for firmly maintaining the entire areas of the image sections against the accordion-folded surfaces) gives rise to the possibility of distortion if the image sections deviate from a precisely planar configuration.

Dual view displays are eye-catching and relatively inexpensive to produce in terms of material costs. However, they have not gained widespread use owing to difficulties encountered during their production. The problem is mainly that of properly sectioning, interleaving, and mounting the dual images on the accordion-folded mounting surface: unless the two images are properly sectioned and the sections are precisely registered on the planar sections corresponding to their respective viewing planes the images will suffer from distortion or an unnatural appearance. If the image sections are cut too small to precisely fit their planar sections, their image will be interrupted by gaps when viewed at a normal; if the sections are cut too large, their image will appear to be missing vertical strips. Further distortion can appear if the vertical edges (horizontal borders) are not cut precisely straight, and/or if any sections are mounted to the mounting surface with a slight offset in a horizontal, vertical, or other directions (i.e., if they are not precisely registered prior to attachment). Quite simply, an error in producing a single section can "break" and ruin the entire image, and since each image is generally divided into numerous sections prior to interleaving and joining the images, the risk of error is high. At FIGS. 14 and 15 and column 6 line 14 onward of Otake, a method of accurately and automatically sectioning, interleaving, and attaching the image sections of FIGS. 6, 11, and 12 is illustrated and described, but this method requires specialized production equipment and is not feasible for the common user.

One solution proposed for the problems of sectioning, interleaving, and registering images is presented in U.S. Pat. No. 3,406,476 to Wilcox. Wilcox describes providing a series of elongated triangular prisms (i.e., beams or tubes having cross-sections shaped like equilateral triangles) which combine to provide an accordion-folded surface when situated side-by-side in parallel relation. The triangular prisms are set side by side within a receiving template so that each has one side situated adjacent to and in the same plane as one side on the other prisms. A continuous planar surface is thus formed. An image-bearing picture may then be glued or otherwise mounted on this surface. The picture may then be cut at the edge of each prism to section the image, thus leaving an image section adhered to each prism. The prisms are then lifted, rotated 120° so that each prism presents a new side (thereby forming another planar surface to which a picture may be affixed), and replaced in the receiving template. Another picture is then mounted to this planar surface and sectioned. The prisms may then be mounted in parallel abutting relation (using the leftover unadorned sides of the prisms as the mounting surface) so that the image sections borne thereon are displayed in adjacent interleaved fashion to provide a dual view display.

While the method and apparatus of Wilcox provides a useful development, it is labor-intensive and difficult to practice. Initially, the cut-and-glue procedure used for sectioning, interleaving, and attaching image sections is time-consuming if a user wishes to obtain the precision necessary to avoid registration problems. Once an image is affixed to the surfaces of multiple prisms, the boundaries between these prisms are obscured, making it difficult for a user to know where to cut to section the images and separate the prisms. If an imprecise cut is made during sectioning, the view of the image sections can be distorted.

Another solution proposed for the problems of sectioning, interleaving, and registration is presented in U.S. Pat. No. 4,233,767 to Hryhorczuk. Hryhorczuk provides a kit including an accordion-folded mounting surface and two template sheets having opposing adhesive-coated faces. The opposing adhesive faces of each template sheet are provided with a protective backing which may be peeled away to reveal the adhesive, and the backing covering one of the adhesive faces is provided with printed lines. These lines divide the backing into an array of planar sections corresponding in size and shape to the planar sections of the accordion-folded mounting surface. The user may take two pictures, peel away the non-lined backing on each template sheet to reveal an adhesive face, and adhere this exposed adhesive face to the rear of a respective picture. The rear of each picture then displays the lined backing of its adhered template sheet. The pictures may then be cut along the printed lines of the backing, thereby sectioning the pictures into image sections sized to fit upon the planar sections of the accordion-folded mounting surface. The lined backing on each of the image sections may then be peeled away, thus providing each image section with an adhesive rear face so that the image sections can be easily adhered to the accordion-folded mounting surface. After being properly interleaved, the image sections are adhered to the accordion-folded mounting surface to complete the dual view display. As with Wilcox, unless the two images are properly sectioned, interleaved, and mounted to the planar sections corresponding to their respective viewing planes, and unless the image sections are mounted with proper registration, the images will suffer from distortion or an unnatural appearance.

The aforementioned drawbacks are not significant if one does not require a "perfect" dual view display, allowing use of less expensive manufacturing measures. As an example, U.S. Pat. No. 4,422,253 to Babberl illustrates a dual view display wherein joined image sections (such as that of FIGS. 6, 11, and 12 of Otake) are accordion-folded and placed in a box which maintains the image sections in a generally accordion-folded shape. Creation of the sheet of joined image sections is subject to the same difficulties as those encountered with Wilcox and Hryhorczuk. However, an additional problem is introduced in that the joined image sections are unsupported by an accordion-folded mounting surface, and thus the image sections are not maintained at precise angles. As a result, the images will suffer from distortion.

The ultimate object of a high-quality dual view display is to have each of its images appear as a continuous two-dimensional image when the image is viewed from a line normal to its viewing plane—in other words, the image should appear to be a standard image mounted on a standard two-dimensional surface. The dual view display will thus appear to viewers to be an ordinary two-dimensional display, but will then create a startling effect when viewers move to a different viewing angle, at which point it will become apparent that more than one image is present. Dual view displays appear deceptively simple to make, but when it is considered that even minor errors in sectioning, interleaving, and registration can significantly degrade image quality, it should be apparent that the additional time and labor needed for precise construction makes dual view displays prohibitively expensive.

SUMMARY OF THE INVENTION

The invention, which is defined by the claims set out at the end of this disclosure, is directed to a dual view display which overcomes the disadvantages noted above to provide an attractive, inexpensive, and rapidly assembled dual view display. A pair of transparent accordion-folded frame members are provided wherein each of the frame members includes several adjacently situated planar frame sections, each frame section being situated at an angle of approximately 90° with respect to adjacent frame sections. The frame members have substantially identical structure and are interchangeable with each other, and thus the frame members are suitable for manufacture in mass quantities within a single production line. Further, owing to their structure, the frame members may be stacked together in complementary and interfitting fashion with their planar sections in parallel relation.

An integrally-formed sheetlike picture insert is then provided for mounting between the stacked frame members. The picture insert includes opposing insert faces, and at least one of these insert faces bears a dual image formed of discrete image sections taken from two selected images. The image sections are interleaved so that for each of the two images, no two of its image sections are adjacently situated within the dual image. Additionally, the image sections are sized so that each image section may be fit entirely between opposing planar frame sections on the frame members when the picture insert is sandwiched between the frame members. As a result, when the edges of the dual image are aligned with the edges of one frame member and the other frame member is placed atop the picture insert so that the picture insert rests between the frame members, the image sections of the dual image are automatically registered with the planar sections of the frame members. Thus, the problems with registration encountered with the prior art methods are avoided. Further, since the picture insert is sandwiched between the two frame members, its image sections are firmly maintained in a planar state at the orientation defined by the planar sections of the frame members. This prevents the image distortion present in the above-noted prior apparata and generates displays of higher resolution.

To produce a picture insert having these qualities, the dual image is preferably produced by computerized sectioning and interleaving of the two selected images. The two images are provided on a computer and are each sectioned into discrete image sections which are scaled (or initially sized outright) for registration with the planar frame sections of a chosen set of frame members. The image sections are interleaved on the computer to produce a dual image. The dual image is then printed on a single continuous sheet. By using computerized scaling, the deficiencies of the prior art (irregularities in size of image sections or straightness of their borders, improper alignment between edges of image sections after interleaving, etc.) may be entirely avoided. Additionally, since a tangible picture insert is not in existence until it is printed, there is no physical sectioning of a potentially valuable print, and thus no loss occurs if sectioning and interleaving is improper. Further, any picture insert borne between the frame sections may be easily and rapidly replaced with a different picture insert so that a different dual image may be displayed. Off-the-shelf software capable of performing the necessary sectioning, interleaving, and other image manipulation steps is available, e.g., PAGEMAKER by Aldus Corporation (Seattle, Wash., U.S.A.) and/or QUARK XPRESS (Quark Inc., Denver, Colo., U.S.A.), or customized programs can be prepared by one of ordinary programming skill. It is notable that while software capable of generating picture inserts has been available since at least 1985, the year that the program PAGEMAKER (v1.0) was released by Aldus Corporation for use on the MACINTOSH personal computer, the inventor does not know of any prior uses of software to generate continuous, integrally-formed picture inserts, much less picture inserts that are properly sectioned, interleaved, and scaled to fit frame members having a predetermined size.

Attachment means may then be provided for affixing the frame members together about the picture insert. A preferred form of attachment means is provided by a U-shaped clip wherein the frame members may be situated. The clip is preferably resiliently bendable so that it can elastically expand to accommodate the frame members and contract to hold the frame members in close relation. This function can be enhanced by including compressible pads within the mouth of the clip so that these pads may also be compressed to accommodate insertion of the frame members, and then may expand to grasp the frame members tightly therein.

As noted above, both frame members are preferably transparent. This allows both sides of the dual view display to display dual images, and it also allows a picture insert within the frame members to be backlit by an illumination source situated behind one side of the dual view display. A preferred embodiment of a backlit dual view display may be provided by surrounding at least a substantial portion of the edges of the frame members within a casing, and then providing an illumination source within the casing and adjacent the frame members. As a result, when the illumination source is activated, the casing directs the light through the innermost frame member within the casing, through the picture insert (which will generally be made of paper or fabric and will thus be partially translucent), and then through the outermost frame member. This backlighting arrangement provides for an especially attractive and eye-catching appearance. Depending on the content of the picture insert and the desired effect, this eye-catching quality may be enhanced by forming the picture insert of substantially transparent material.

It is notable that a dual view display may be assembled with use of more than two of the aforementioned frame members where a larger dual view display is desired, or where disassembly and easy portability of a dual view display is desired. In this case, several of the aforementioned frame members are situated in a side-by-side array with abutting side and/or top and bottom edges, thereby effectively constituting a larger frame member. An identical array of frame members may then be posed in parallel relation so that a picture insert may be accommodated between the two arrays.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
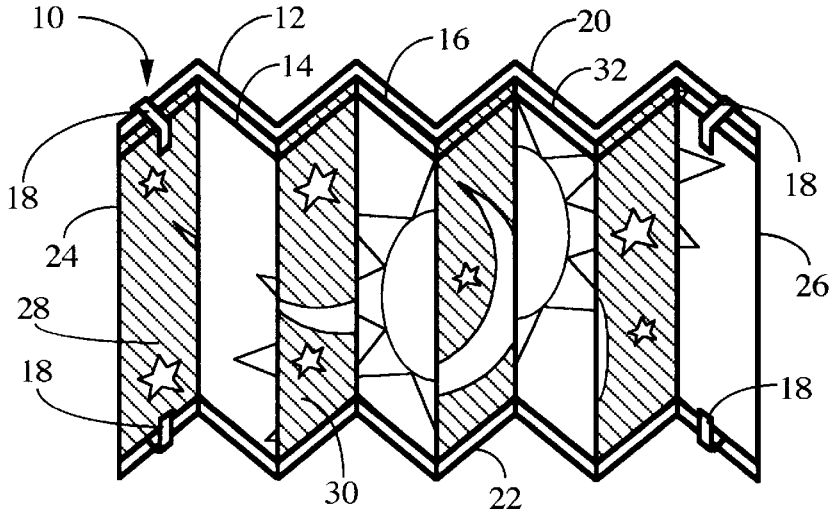
FIG. 1 is a perspective view of a first preferred embodiment of a dual view display in accordance with the invention.
Figure 2:
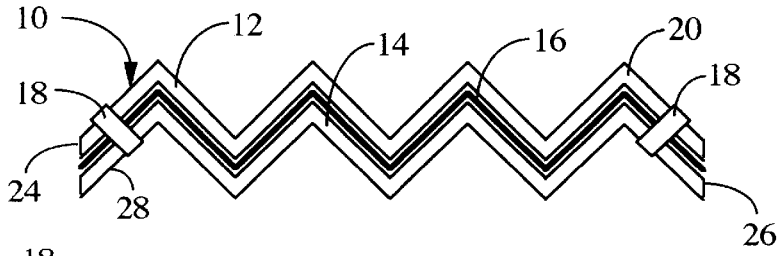
FIG. 2 is a top plan view of the dual view display of FIG. 1.
Figure 3:
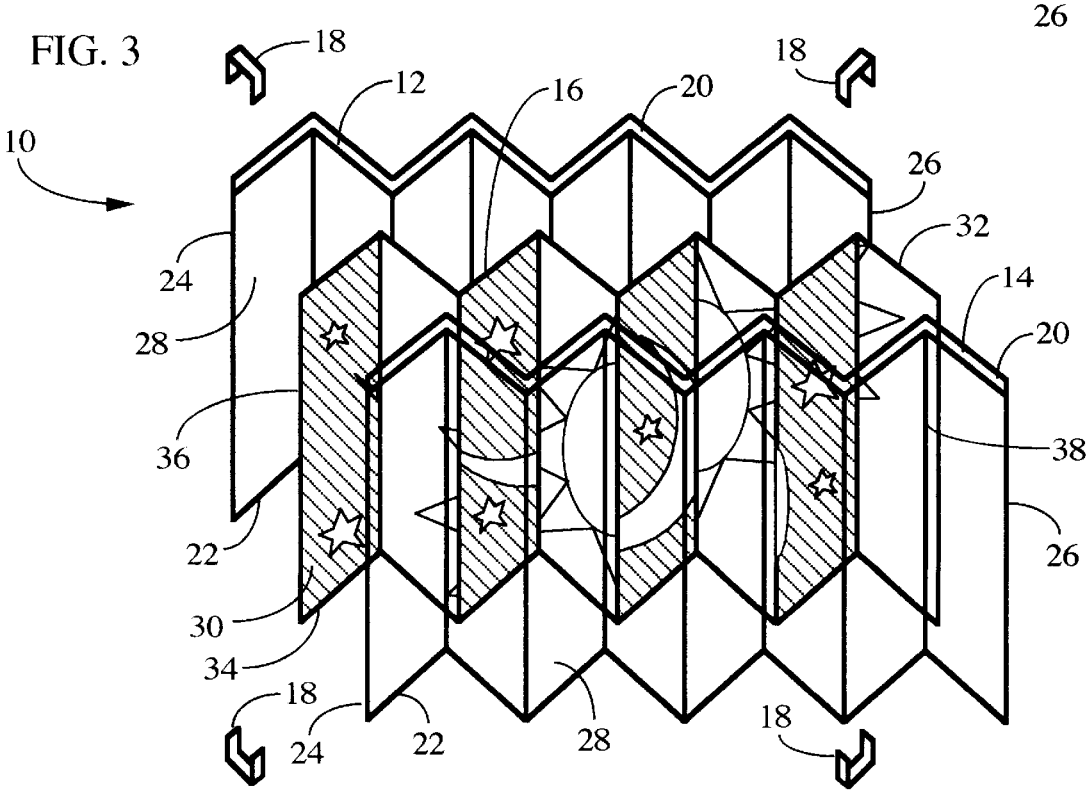
FIG. 3 is an exploded view of the dual view display of FIG. 1.

In the drawings, wherein the same or similar features of the invention are designated in all Figures with the same reference numerals, FIGS. 1–3 illustrate a first preferred embodiment of the new dual view display at 10. The dual view display 10 includes two transparent accordion-folded frame members 12 and 14, and a sheetlike picture insert 16 which is situated between the frame members 12 and 14 when the dual view display 10 is assembled as in FIG. 1. Attachment means, in this case clips 18, are then used to firmly affix the frame members 12 and 14 together with the picture insert 16 situated therebetween. The structure of the frame members 12 and 14, the picture insert 16, and the clips 18 will now be discussed in greater detail in turn.

As noted above, the frame members 12 and 14 of FIGS. 1–3 both have an accordion-folded configuration, and are preferably both transparent. The feature of transparency may be imparted by forming the frame members 12 and 14 of a proper transparent material, with transparent plastic such as acrylic being particularly preferred. As implied by the term "accordion-folded," each of the frame members 12 and 14 includes opposing upper and lower edges 20 and 22, opposing lateral edges 24 and 26 and several adjacently-situated planar frame sections 28 arrayed between the lateral edges 24 and 26 in side-by-side fashion. Each of the planar frame sections 28 has substantially identical size, with each planar frame section 28 being at an angle to its adjacent planar frame section 28. Further, the planar frame sections 28 are each parallel to one of two viewing planes, with alternate planar frame sections 28 being parallel to the same plane.

Each planar frame section 28 is preferably situated at an angle of approximately 90° with respect to adjacent planar frame sections 28. As a result, when a viewer views the frame member 12/14 from a vantage point wherein the viewer's line of sight is approximately perpendicular to one set of alternating planar frame sections 28, this set of alternating planar frame sections 28 (and the sections of the picture insert 16 situated behind these planar frame sections 28) will be visible to the exclusion of the other set. Angles at or substantially near 90° are most preferable because these provide the greatest coherence of images. In contrast, acute angles generate images which appear to be missing strips from their image sections, and obtuse angles generate images wherein their image sections are separated by strips of the other image.

In addition, the frame members 12 and 14 have substantially identical structure, that is, frame member 12 is interchangeable with (and indistinguishable from) frame member 14. As a result, frame members 12 and 14 may be situated in closely spaced or abutting relation with their edges 20, 22, 24, and 26 aligned and their planar frame sections 28 in parallel alignment (as shown in FIG. 1). The dual view display 10 can thus be extremely rapidly assembled in the manner shown in FIG. 1 because the frame members 12 and 14 accommodate each other in complementary and interfitting fashion. This feature is particularly advantageous where the frame members 10 and 12 are used with a picture insert 16 having the structure described below.

Figure 4:
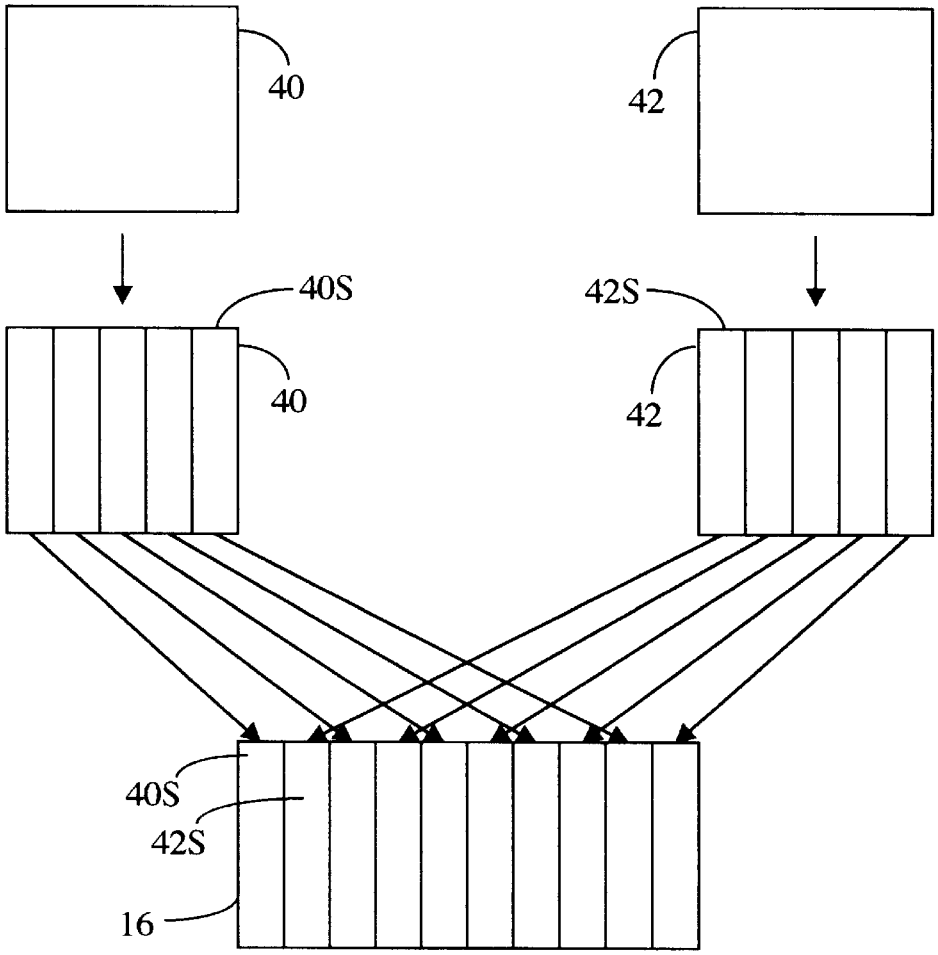
FIG. 4 is a schematic view of a preferred process for producing a picture insert for use within the dual view display of FIGS. 1–3.

The structure of the picture insert 16 is then best understood with reference to FIG. 3. Picture insert 16 is formed of a continuous piece of sheetlike material having opposing insert faces 30 bounded by opposing upper and lower edges 32 and 34 and opposing lateral edges 36 and 38 (best shown in FIG. 3). At least one insert face 30 bears a dual image which is preferably formed via the following process, which is schematically illustrated in FIG. 4;

First, two images 40 and 42 are provided, these images 40 and 42 being selected as desirable for placement in the different viewing planes of the dual view display 10 for viewing. The images 40 and 42 may be any suitable images, e.g., photographic representations, and can constitute sections or scaled versions of larger images.

Second, the images 40 and 42 are then sectioned to produce an array of adjacently situated image sections 40S and 42S which are sized the same as (or scaled proportionately to) the planar frame sections 28 of the frame members 12 and 14.

Third, the image sections 40S and 42S are then interleaved, that is, adjacent image sections of each image are interrupted with an image section from the other image. An array of image sections is thus formed wherein the sections of each image are alternating.

Fourth, the interleaved image sections 40S and 42S are joined edge-to-edge to generate a "dual image" for display on the sheetlike picture insert 16. The dual image can be rescaled so that the image sections 40S and 42S are sized the same as the planar frame sections 28 of the frame members 12 and 14, if the image sections were not already sized in this manner.

Unlike the prior art dual view displays described at the outset of this disclosure, this process of sectioning and interleaving images 40/42 is preferably not done physically, but is rather done on a computer using image manipulation software. There are numerous advantages to using image manipulation software to produce the picture insert 16 rather than using physical sectioning, interleaving, and joining processes. Computerized sectioning produces far more uniform and regular image sections 40S/42S, and irregularities in size or straightness of image section borders are avoided. Interleaving and joining are far more precise; no offsets in upper and lower edges of image sections 40S/42S are produced, and adjacent image sections 40S/42S need not be inadvertently spaced or overlapped. Further, computerized processing is not as messy and time-consuming as the prior manual cut-and-glue methods, and it is further safer in that it is "reversible": backups of the original images 40 and 42 can be stored, and one does not run the risk of irrevocably cutting a valuable print into sections only to learn that sectioning was improperly done, or that its image is not appropriate for a dual view display. Computerized processing also has the advantages that retouching and the addition of text (or other matter which was not originally present in the images) can generally be easily performed.

FIGS. 5*a*–5*h* then schematically illustrate the application of the process of FIG. 4 to two images A and B by use of a commonly-available image processing/desktop publishing program, e.g., PAGEMAKER (from Aldus Corporation, Seattle, Wash., U.S.A.) or QUARK XPRESS (from Quark Inc., Denver, Colo., U.S.A.).

Figure 5A:
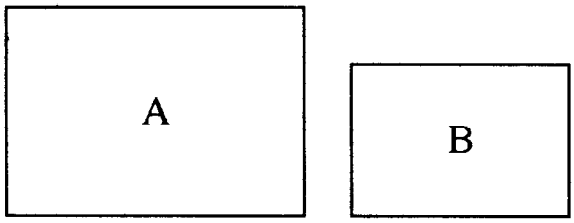
FIGS. 5*a*–5*h* schematically illustrate in greater detail a preferred process for producing a picture insert for use within the dual view display of FIGS. 1–3.

In FIG. 5*a*, two images A and B which are to be converted to a dual image are provided or imported into a standard page layout screen of one of the aforementioned programs (or similar programs). Here, the two images A and B are of dissimilar size.

Figure 5B:
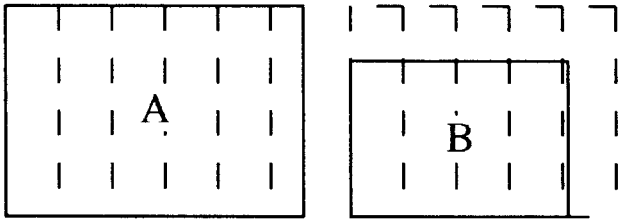

In FIG. 5*b*, grid patterns are defined which are sized the same as (or scaled proportionately to) the frame members 12/14 in which the dual image is to be used. The grid patterns are superimposed over images A and B (each image being assigned one grid pattern) in such a manner that the grid encompasses the portions of the images A and B that are ultimately desired to be encompassed in the dual image.

Figure 5C:
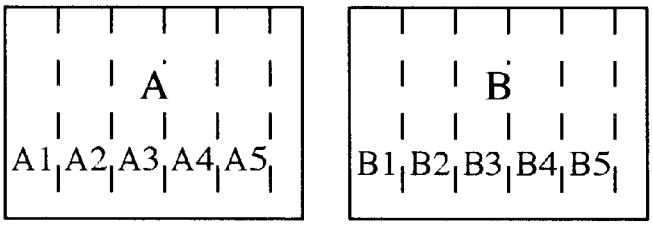

In FIG. 5*c*, image B is rescaled to approximately the same size as image A, or to another desired size. Taken together, the steps illustrated in FIGS. 5*b* and 5*c* amount to rescaling the images to a desired size and "framing" the desired areas of images A and B with the grid patterns. The grid patterns thus define image sections A1, A2, A3, A4, and A5 and B1, B2, B3, B4, and B5 within images A and B. As FIG. 5*c* illustrates, the images A and B here have such a size that portions of their areas do not fit within image sections A1, A2, A3, A4, and A5 and B1, B2, B3, B4, and B5.

Figure 5D:
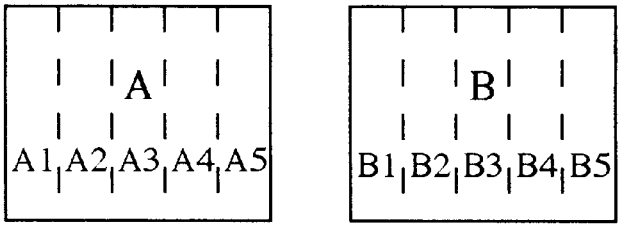

In FIG. 5*d*, excess portions of images A and B—i.e., those portions which rest outside the boundaries of the grid patterns—are cropped, thereby eliminating the portions of images A and B outside of image sections A1–A5 and B1–B5. Thus, images A and B are cropped to have their edges coincide with the grid patterns.

Figure 5E:
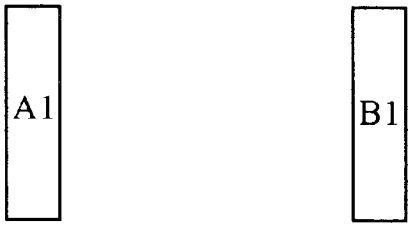

In FIG. 5*e*, the images A and B are then horizontally compressed to fit within a single section of the grid patterns (which may then be removed). This "compression" does not distort the contents of images A and B, but rather masks a horizontal portion of each image so that this portion is not displayed. In the PAGEMAKER program, leftward compression results in the display of image sections A1 and B1 wherein only the leftmost sections of images A and B are illustrated; image sections A2–A5 and B2–B5 are not visible.

Figure 5F:
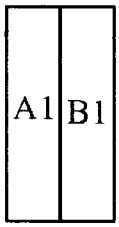

In FIG. 5*f*, the image sections A1 and B1 are situated in lateral abutment with their top and bottom edges vertically aligned.

Figure 5G:
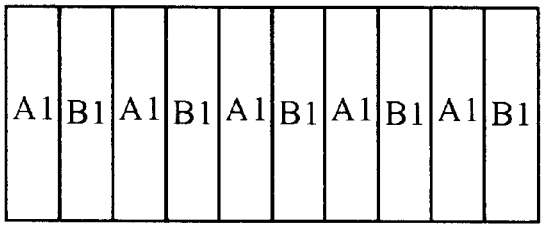

In FIG. 5*g*, the abutting image sections A1 and B1 of FIG. 5*f* are reproduced n times (where n is the number of sections within each grid pattern) and situated in the manner illustrated, with each A1/B1 pair laterally abutting another A1/B1 pair and with their top and bottom edges vertically aligned.

Figure 5H:
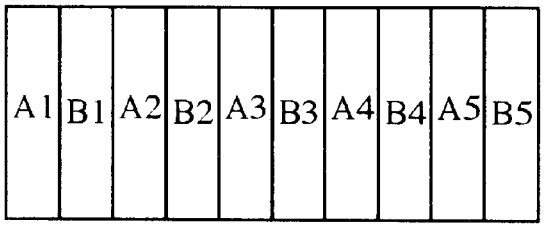

In FIG. 5*h*, the image sections A1 and B1 are expanded to bring image sections A2–A5 and B2–B5 into view. As a result, images A and B are perfectly sectioned, interleaved, and aligned in a dual image which is sized the same as (or scaled proportionately to) the frame members 12/14 in which it is to be used. With reference to FIGS. 1–4, the dual image can then be printed in the proper scale such that a picture insert 16 is provided which fits within frame members 12 and 14 with all image sections precisely aligned with corresponding planar frame sections 28.

Off-the-shelf software capable of performing the necessary image manipulation is readily available, e.g., the aforementioned PAGEMAKER and QUARK XPRESS programs. Such software is often capable of accommodating routines which are predefined by users (i.e., "macros"), thereby allowing users to customize the software to automatically scale, section, interleave, and join two images to accommodate frame members 12/14 having predetermined dimensions and a given number of planar frame sections 28. The necessary steps could instead be readily performed by custom-programmed image manipulation software or hardware. As an example of the utility of custom-programmed software, a set of frame members 12 and 14 can be sold pre-packaged with a computer-readable disk containing a program which is dedicated to creating a picture insert 16 for a particular set of frame members 12/14 in question. The user can provide two images to the program from any suitable source—for example, scanned from photographs, taken from a digitized collection, downloaded from a computer network, or provided from a digital camera or a computer/video recorder interface—and the program can then generate the picture insert 16 from the two images with no (or minimal) need for input from the user. Provided the user has a high-quality printer, the picture insert 16 can then be printed for mounting within the frame members 12 and 14.

As noted above, with reference to FIGS. 1–4, the software will preferably section the images 40 and 42 and interleave and scale the image sections 40S/42S to generate a picture insert 16 having such a form that its image sections 40S/42S are automatically registered with their appropriate planar frame sections 28 when the picture insert 16 is sandwiched between two frame members 12/14. As an example, a picture insert 16 may be provided in such a form that it can be taken directly from the printer, one or more of its edges 32, 34, 36, 38 can be registered with the corresponding edges 20, 22, 24, 26 of one frame member 12, and the other frame member 14 can be placed atop the picture insert 16 to complete the dual view display 10. Owing to the complementary fit between the frame members 12 and 14, placement of the frame member 14 atop the picture insert 16 and the frame member 12 will automatically press the picture insert 16 against the frame member 12 and 14 with its image sections 40S/42S properly registered with the planar frame sections 28 of the members 12/14 (so long as the picture insert edges 32, 34, 36, 38 and frame member edges 20, 22, 24, 26 were initially registered).

As another example, the picture insert 16 might bear a dual image which does not occupy the entirety of the area of the picture insert 16 (in other words, the picture insert 16 may be printed in a size larger than necessary to fit within the frame members 12/14). In this case, the size of the picture insert 16 might be trimmed to the borders of the dual image. The edges 32, 34, 36, 38 of the picture insert 16 can then be registered with one frame member 12, and the other frame member 14 can be placed atop the picture insert 16 to complete the dual view display 10 in the manner described above. Alternatively, the picture insert 16 need not be trimmed, and the edges of the dual image borne thereon can simply be registered with the edges 20, 22, 24, 26 of one frame member 12 prior to installation of the other frame member 14.

Another advantage of the use of software-driven image manipulation steps is that it allows users to create picture inserts 16 over computer networks, for example, the World Wide Web. To illustrate, users might access a web site, provide it with two images 40 and 42 desired for a dual view display 10, and choose appropriately-sized frame members 12/14 offered for sale at the site. The web site may then process the images 40 and 42 to produce a picture insert 16 which is appropriately scaled for the chosen size of the frame members 12 and 14. The pictures inset 16 may then be printed using high-quality processes and mailed to the user along with the selected frame members 12 and 14. The picture insert 16 can be installed by the use between the frame members 12/14 to complete the dual view display 10 at home, e.g., one or more of the edges 32, 34, 36, and 38 of the picture insert 16 may be aligned with one or more of the edges 20, 22, 24, 26 of one frame member 12, and the other frame member 14 may then be placed atop the picture insert 16 to automatically situate the image sections 40S and 42S of the picture insert 16 between their appropriate planar frame sections 12/14.

Figure 6:
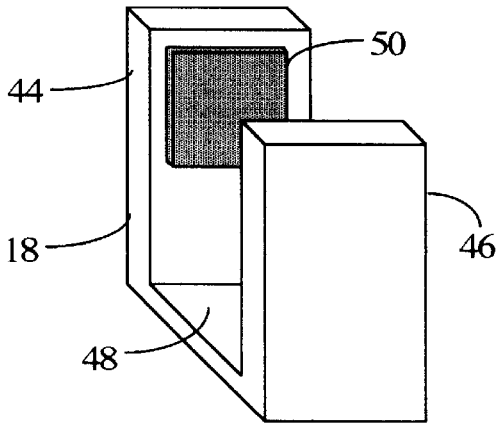
FIG. 6 is a perspective view of the clip 18 of FIGS. 1–3, the preferred attachment means used for attaching the frame members 12 and 14 together about the picture insert 16.

FIG. 6 illustrates in greater detail a preferred embodiment of the clip 18, the attachment means shown in FIGS. 1–3 for attaching the frame members 12 and 14 together about the picture insert 16. The clip 18 has a U-shape including two joined arms 44 and 46 with a valley 48 defined therebetween. Compressible pads 50 (e.g., thin foam rubber pads) are preferably affixed to each of the arms 44 and 46 adjacent the valley 48. The clip 18 is itself preferably made of resiliently flexible metal, that is, its arms 44 and 46 may be pulled apart, but will move back to their original position when tension is removed. As a result, where the frame members 12 and 14 are closely received within the valley 48, the arms 44 and 46 (and more particularly the pads 50) will exert inward pressure on the frame members 12 and 14 to maintain them tightly about the picture insert 16. The pads 50 may be omitted, but they are of assistance in preventing scratching of the frame members 12 and 14 when the clip 18 is being installed, and they additionally work in tandem with the natural elasticity of the arms 44/46 to tightly grip the frame members 12 and 14 and hold them together.

Figure 7:
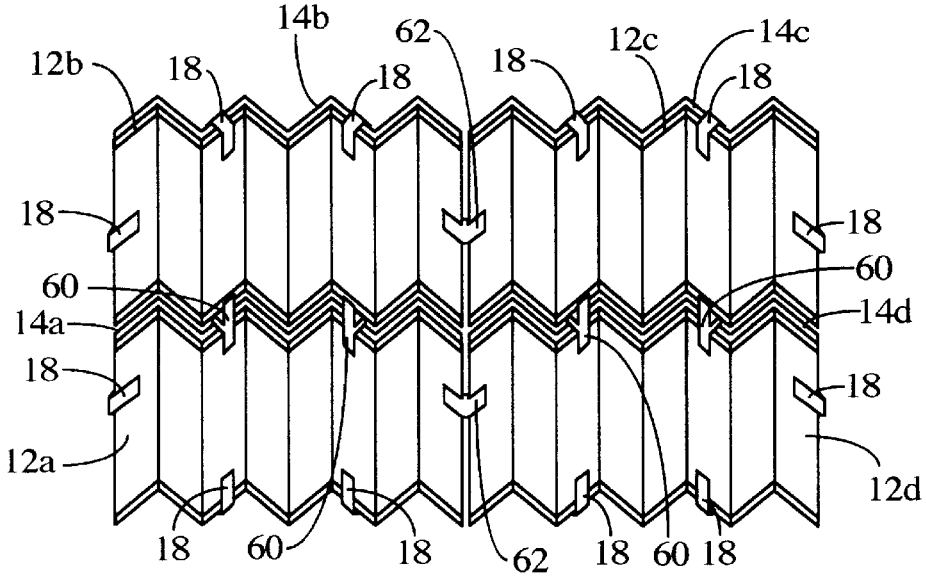
FIG. 7 is a perspective view of a second preferred embodiment of a dual view display in accordance with the invention.

FIG. 7 then illustrates an arrangement wherein multiple frame members 12*a*, 12*b*, 12*c*, 12*d* and 14*a*, 14*b*, 14*c*, 14*d* are adjacently arrayed with abutting lateral and upper/lower edges to effectively create a frame member of greater size. (For enhanced clarity, the frame members are illustrated in FIG. 7 without the picture insert and with their lateral and upper/lower edges shown slightly separated.) Alternatively, this arrangement can be viewed as a dual view display wherein each frame member is formed from a series of smaller accordion-folded panels. H-shaped clips 60 or other suitable attachment means can be used to maintain the edges of adjacent sets of frame members together. This arrangement is advantageous when larger dual view displays are desired and it is helpful to have the components of the dual view display be of smaller size for easier storage and transport. As an example, where a user wishes to utilize a dual view display at a convention or trade show booth, the use of the multiple frame members 12 and 14 illustrated in FIG. 7 wherein each frame member measures 0.5 mm×0.5 mm would generally be easier for a user to transport than two 1.0 m×1.0 m frame members.

Figure 8:
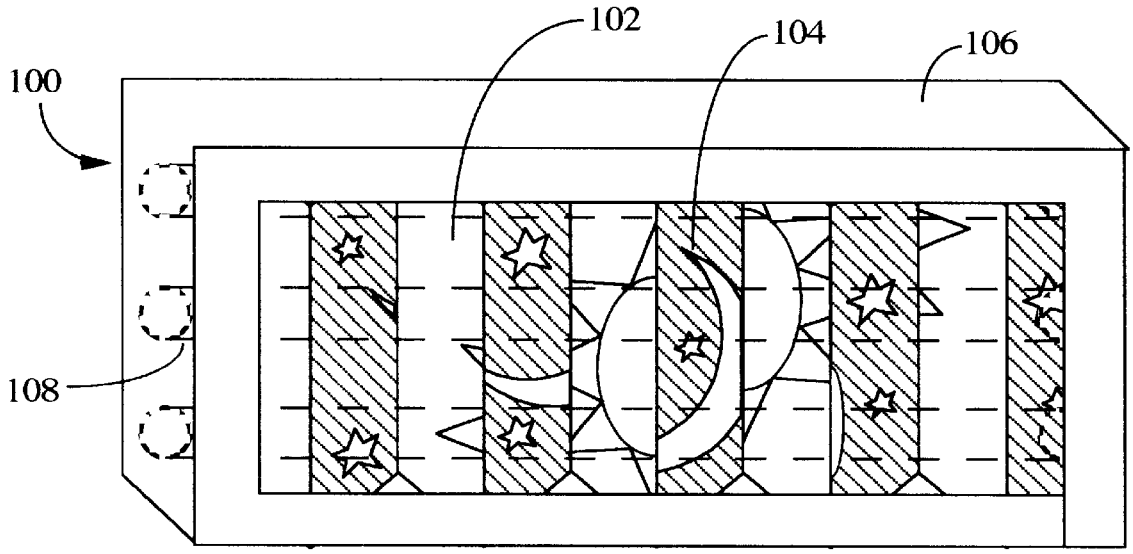
FIG. 8 is a perspective view of a third preferred embodiment of a dual view display in accordance with the invention.

FIG. 8 then illustrates another exemplary embodiment of the dual view display at 100. The dual view display 100 includes frame members 102 which are similar to frame members 12 and 14 (with only the foremost frame member being visible here). Also included is a picture insert 104 (visible through the front frame member 102) similar to picture insert 16. A case 106 then surrounds at least a substantial portion of the edges of the frame members 102, and an illumination source 108 (shown in phantom) is situated within the case 106 behind the frame members 102. Because the case 106 substantially surrounds the illumination source 108 and the rear frame member 102 is transparent, light from the illumination source 108 is primarily directed onto the rear of the picture insert 104. Because the picture insert 104 will generally be made of paper or fabric and will thus be at least partially translucent under light of sufficient intensity, the picture insert 104 will be backlit when the illumination source 108 is active. This enhances the visibility of the picture insert 104 and enhances the overall attractiveness of the dual view display 100. As the phantom line illustration of the illumination source 108 suggests, the illumination source is preferably provided by one or more fluorescent lights since these generally have a lower operating temperature than incandescent lights. However, incandescent lights or other forms of illumination sources 108 can be used if precautions are taken against overheating.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. Following is an exemplary list of such modifications.

First, it is notable that the results of the dual view display 10 may be slightly enhanced where the upper, lower, and lateral edges 20, 22, 24, and 26 of the frame members 12 and 14 are made less transparent (e.g., scuffed or covered with paint). This is because the frame members 12 and 14, preferably being made of transparent material, are susceptible to ambient light entering the edges 20, 22, 24, and 26, travelling through the frame members 12 and 14 via transmission and internal reflection, and then leaving the faces of the planar frame sections 28. This can lead to an appearance of enhanced "glare" which can be avoided if the edges 20, 22, 24, and 26 are made with low light transmissivity (e.g., when they are covered with paint) or high absorptivity (e.g., wherein their surfaces are scuffed or roughened).

Second, in FIGS. 1–3, the lateral edges 24 and 26 of the frame members 10 and 12 are shown as being angled at approximately 45° to the faces of the planar frame sections 28. This is advantageous because it allows easier and stronger mounting of the lateral edges 24 and 26 within a fixture such as the case 106 of FIG. 8 (since the lateral edges 24 and 26 can abut the sides of the case 106 over their entire surfaces), and it will also decrease the entry of light at the lateral edges 24 and 26 and emission after internal reflection (as noted above). However, the lateral edges 24 and 26 could instead be situated at other angles with respect to the planar frame sections 28.

Third, as noted above, both frame members 12 and 14 are preferably transparent. This allows both sides of the dual view display 10 to display images provided the dual view display 10 is used with picture inserts 16 having dual images on both of the opposing insert faces 30, or where two picture inserts 16 are placed back-to-back and inserted between the frame members 12 and 14. However, where only one side of the dual view display 10 is to be used to display images, the frame member 12 or 14 which is not being viewed can be made of non-transparent material.

Fourth, it should be understood that attachment means apart from the clip 18 may be used to attach the frame members 12 and 14 together. As an example, the frame members 12 and 14 could be attached by driving fasteners through both frame members 12 and 14; by affixing the frame members 12 and 14 together via adhesives, welding, tape (preferably transparent), or bands; or by incorporating structure on one frame member 12 which is complementarily received by (or otherwise attachable to) mating structure on the other frame member 14 (e.g., a tongue protruding from one frame member which is received by a complementary aperture in the other frame member).

Fifth, it is notable that a picture insert formed in accordance with the processes described above may be accordion-folded and used as a dual-view display separately from frame members 12 and 14. Because the frame members 12 and 14 will not be used to hold the image sections of the picture insert each in a planar from at the desired orientation, portions of the picture insert may sag or may not be properly angled with respect to adjacent portions, and the resulting dual view display may be subject to distortion. However, it can still provide a dual view display which is superior to those produced by prior art methods. It is also notable that a picture insert of this sort may be incorporated into commonly encountered printed matter such as paperback book covers, greeting cards, business cards, posters, and the like. As an example, a paperback book or greeting card may be formed with an oversized front cover which bears a dual image over all or a portion of its surface. The dual image may then be pressed between ridged surfaces configured like frame members 12 and 14 to rapidly form the cover into an accordion-folded shape so that the cover serves as a dual view display. This process can be performed more conveniently by configuring the press with a holder for gripping one edge of the cover, or guiding surfaces which abut the cover's edges when the cover is received by the press, in such a way that the portion of the cover bearing the dual image is aligned with the ridged portion of the press. As a result, when the press is actuated, the portion of the cover bearing the dual image will automatically be properly aligned with the ridges and pressed into an accordion-folded shape. If portions of the cover which are not to be bent into an accordion-folded shape, the ridged press may bear lands adjacent the ridges which accommodate and abut these portions so that they remain unfolded. As an example, a press may be formed with a female receptacle having an accordion-folded floor and a male member having a complementarily-shaped accordion-folded face. A business card placed within the female receptacle (which is properly sized and configured to receive the business card) can then automatically be stamped into an accordion-folded form when the male member closes on the business card and presses it onto the floor of the female receptacle. The floor of the female receptacle and the face of the male member may also bear complementary flat lands adjacent the ridges so that sections of the pressed business card remain in a flat state.

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A dual view display comprising:

a. a pair of transparent accordion-folded rigid frame members, wherein each of the frame members includes opposing upper and lower edges, opposing lateral edges, and several adjacently situated planar frame sections situated therebetween, each frame section being situated at an angle of approximately 90° with respect to adjacently situated frame sections, and further wherein each of the frame members has a structure substantially identical to the structure of each other frame member, whereby the frame members may be situated in closely spaced relation with their edges aligned and their planar frame sections in parallel alignment, b. a picture insert integrally formed of a single continuous sheet, wherein the picture insert has opposing lateral edges with opposing insert faces situated therebetween:

wherein at least one insert face bears a dual image directly printed thereon, the dual image including discrete image sections taken from two digital images sectioned by computer, and further wherein the image sections are interleaved by computer so that for each of the two images, no two of its image sections are adjacently situated, and further wherein the image sections are sized and configured such that when the picture insert is situated between the frame members when the frame members are closely spaced with their edges aligned and their planar frame sections in parallel alignment, the image sections are each automatically registered entirely between two planar frame sections, one such planar frame section being on each frame member.

2. The dual view display of claim 1 further comprising attachment means for affixing the frame members together about the picture insert.

3. The dual view display of claim 2 wherein the attachment means comprises a flexibly resilient U-shaped clip including two joined arms with a valley defined therebetween, whereby the frame members may be inserted within the valley with the arms exerting inward pressure to hold the frame members together.

4. The dual view display of claim 3 wherein the arms of the clip include resilient compressible pads adjacent the valley.

5. The dual view display of claim 1 wherein the picture insert is integrally formed of a single continuous sheet of substantially transparent material.

6. The dual view display of claim 1 wherein the opposing insert faces of the picture insert each bear a dual image directly printed thereon.

7. The dual view display of claim 1 wherein the frame members are situated in closely spaced relation with their edges aligned and their planar frame sections in parallel alignment, the dual view display further comprising:

a. a case surrounding at least a substantial portion of the edges of the frame members, b. an illumination source situated within the case.

8. The dual view display of claim 1 further comprising supplementary pairs of transparent accordion-folded frame members, wherein all pairs are adjacently arrayed along a plane with abutting edges.

9. A dual view display comprising:

a. two or more accordion-folded rigid frame members, at least one of the frame members being transparent, wherein each of the frame members includes several adjacently situated planar frame sections each oriented at an angle of approximately 90° with respect to adjacent frame sections, and further wherein each frame member has a structure substantially identical to the structure of each other frame member, b. a picture insert having opposing insert faces extending between opposing lateral edges, the picture insert being integrally formed of a single continuous sheet, wherein at least one insert face bears a dual image formed of discrete image sections taken from two digital images sectioned by computer, and further wherein the image sections are interleaved by computer so that for each of the two images, no two of its image sections are adjacently situated, and further wherein each image section is fit between two of the planar frame sections which are closely situated in parallel relation, and c. attachment means for affixing two or more of the frame members together about the picture insert.

10. The dual view of claim 9 wherein the attachment means comprises a U-shaped clip curving about a valley, whereby two of the frame members may be inserted within the valley with the clip pressing the two frame members together.

11. The dual view of claim 10 wherein the clip includes resilient compressible pads situated thereon adjacent the valley.

12. The dual view display of claim 9 further comprising a case having an illumination source therein, the case being adapted to maintain the frame members within the case and adjacent to the illumination source.

13. The dual view display of claim 9 wherein multiple frame members are adjacently arrayed about each insert face of the picture insert, with the picture insert being maintained between the multiple frame members.

14. A method of producing a dual display comprising:

a. providing at least two accordion-folded frame members, at least one of the frame members being transparent, wherein each of the frame members includes opposing lateral edges having several adjacently situated planar frame sections situated therebetween, each frame section being situated at an angle of approximately 90° to adjacently situated frame sections, and further wherein each of the frame members has a structure substantially identical to the structure of each other frame member;

b. providing two images on a computer, c. sectioning the two images into discrete image sections on the computer, d. interleaving the image sections on the computer to provide a dual image, wherein for each of the two images, no two of its image sections are adjacently situated; and e. printing the dual image on a single continuous sheet to provide a sheetlike picture insert having opposing lateral edges with opposing insert faces situated therebetween, at least one of the insert faces bearing the dual image thereon, wherein the picture insert and the image sections borne thereon are sized and configured such that when the picture insert is situated between two frame members having their lateral edges aligned and their frame sections in parallel alignment, the image sections are each automatically registered entirely between two frame sections, one such frame section being on each frame member; and c. situating the picture insert between two of the frame members.

15. The method of claim 14 further comprising the step of scaling the dual image to fit between two frame members with its image sections automatically registered with the frame sections.

16. The method of claim 14 wherein the frame members are rigid.

* * * * *